US006510776B2

(12) United States Patent
Sirmalis et al.

(10) Patent No.: US 6,510,776 B2
(45) Date of Patent: Jan. 28, 2003

(54) IMMEDIATE BATTLE DAMAGE ASSESSMENT OF MISSILE ATTACK EFFECTIVENESS

(75) Inventors: John E. Sirmalis, Barrington, RI (US); Bernard J. Myers, Bristol, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/853,935

(22) Filed: May 11, 2001

(65) Prior Publication Data

US 2002/0166442 A1 Nov. 14, 2002

(51) Int. Cl.[7] ..... F41F 5/00
(52) U.S. Cl. ..... 89/1.11; 244/3.12
(58) Field of Search ..... 89/1.11; 244/3.12

(56) References Cited

U.S. PATENT DOCUMENTS 4,163,535 A * 8/1979 Austin
4,354,419 A * 10/1982 Patterson
4,935,620 A * 6/1990 Schotter et al.
5,056,740 A * 10/1991 Roth et al.
5,111,748 A * 5/1992 Thurner
5,186,414 A * 2/1993 Holzschuh et al.
5,188,315 A * 2/1993 Foitzik et al.
5,339,742 A * 8/1994 Hulderman et al.
5,432,546 A * 7/1995 Cargill ..... 244/1 TD
5,458,041 A * 10/1995 Sun et al.
5,467,681 A * 11/1995 Liberman
5,470,032 A * 11/1995 Williams, Jr. et al.
5,537,909 A * 7/1996 Schneider et al.
5,537,928 A * 7/1996 Schneider
RE35,553 E * 7/1997 Li
5,841,059 A * 11/1998 Laurend et al.
6,380,906 B1 * 4/2002 Cesulka ..... 342/2

* cited by examiner

*Primary Examiner*—Michael J. Carone
*Assistant Examiner*—Troy Chambers
(74) *Attorney, Agent, or Firm*—Michael J. McGowan; James M. Kasischke; Michael F. Oglo

(57) ABSTRACT

A weapon system and method is provided to obtain damage assessment data immediately after impact of a missile. The missile releases the pod a short time before impact. The pod contains a parachute, a small camera and communications equipment. When released, the pod deploys the parachute to slow its descent and to direct the camera to the proper orientation so as to capture the impact and damage resulting from the impact. Using its communications equipment, the pod relays the impact and resulting damage data back to launch control. The system and method thus provide launch control with immediate battle damage assessments without requiring a launch platform to remain in the battle arena, or without requiring a reconnaissance platform to enter the arena to obtain the damage assessment data.

10 Claims, 2 Drawing Sheets

IMMEDIATE BATTLE DAMAGE ASSESSMENT OF MISSILE ATTACK EFFECTIVENESS

STATEMENT OF GOVERNMENT INTEREST

The invention described herein may be manufactured and used by or for the Government of the United States of America for governmental purposes without the payment of any royalties thereon or therefore.

CROSS-REFERENCE TO RELATED APPLICATIONS

There are no related patent applications.

BACKGROUND OF THE INVENTION (1) Field of the Invention

The present invention relates generally to battle damage assessment, and more particularly to damage assessment immediately after impact of a remotely fired missile.

(2) Description of the Prior Art

The televising of recent hostilities has familiarized the general public with the use of "smart bombs" and cruise missiles in such conflicts. These weapons generally take two forms. The first is a laser-guided weapon where the target is illuminated by a laser. In this case, the launching platform or other nearby platform illuminates the target and the weapon homes in on the laser energy reflected from the target. Typically, the laser illumination includes a camera that records the impact of the weapon and which can be used to assess the damage at the target location. However, the need for a platform to be in the general battle area to illuminate the target puts the platform at risk during launch and subsequent damage assessment.

The second type of "smart" weapon consists of self-guided, or pre-programmed missiles, such as a cruise missile. These weapons are generally launched from a platform remote from the battle area, thus providing platform protection. The weapon can include a guidance camera, which also transmits pictures back to the platform during flight. However, the camera is operative only until weapon impact. There is no opportunity to obtain assessment of the damage caused by the weapon without resorting to the use of some sort of reconnaissance platform within the battle area.

SUMMARY OF THE INVENTION

Accordingly, it is an object of the present invention to provide a weapon system and method for immediate battle damage assessment.

Another object of the present invention is to provide a weapon system and method that can assess battle damage without putting a launch or reconnaissance platform at risk within the battle area.

Still another object of the present invention is to provide a weapons system and method that can be launched from a platform remote from the battle area and can supply damage assessment back to the platform after impact.

Other objects and advantages of the present invention will become more obvious hereinafter in the specification and drawings.

In accordance with the present invention, a weapon system and method is provided in which a missile is fitted with a releasable pod containing a small camera. As the missile approaches its target, sensors within the missile release the pod a short time immediately before impact. When released, the pod deploys a parachute to slow its descent and to further place the camera in the proper orientation to capture the impact and damage resulting from the impact. The pod also contains communications capabilities to relay the impact and resulting damage data back to launch control.

The system and method thus provide launch control with immediate battle damage assessments such that successive launches can be retargeted away from targets sufficiently damaged, or towards targets not sufficiently damaged. When used in combination with laser-guided weapons, the battle damage assessment is obtained without the need for maintaining the launching/guiding platform within the battle arena. The platform can vacate the arena as soon as the weapon has been properly guided to its target. The impact and damage data is obtained in the same manner as the data transmitted from the guidance camera of a self-guided or pre-programmed missile prior to impact. When used in combination with one of these missiles, such as in combination with a cruise missile, the pod may contain a separate camera in addition to the guidance camera. Thus, transmission does not stop on impact. Rather, transmission from the pod camera allows the remote launch platform to receive transmissions after impact from which damage assessments can be made. For those pre-programmed missiles not relying on the camera for guidance, or for those weapons systems that the release of the guidance camera shortly before impact will not effect their targeting, the pod camera can replace the standard camera used to transmit flight pictures to the launch platform.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals refer to like parts and wherein.

DESCRIPTION OF THE PREFERRED EMBODIMENT

Figure 1:
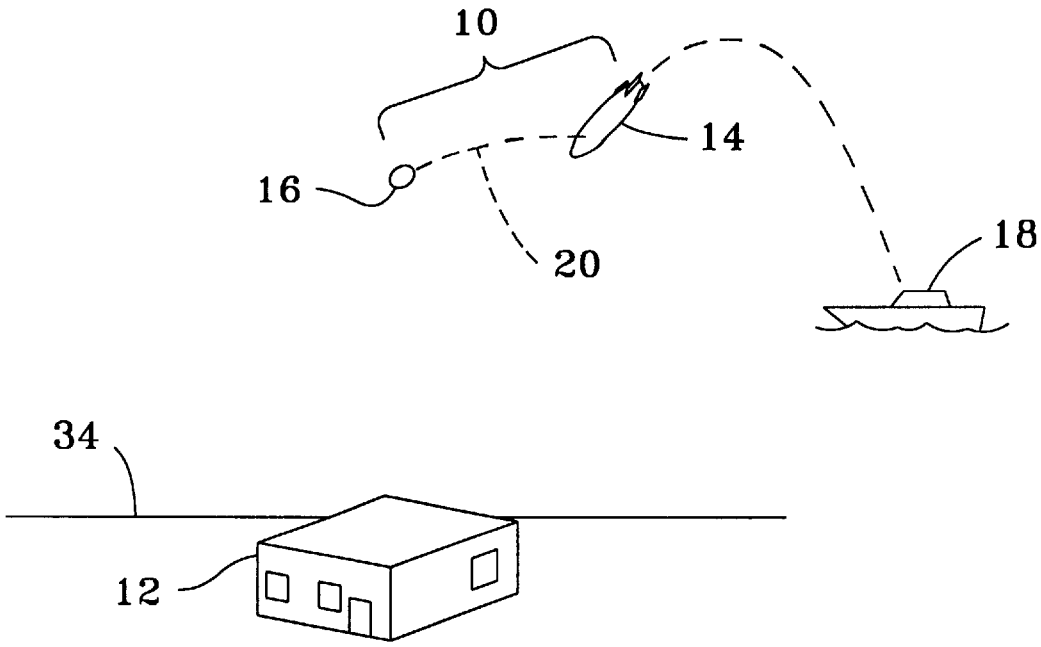
FIG. 1 is an illustrative view of the weapon system of the present invention deploying a surveillance pod.

Referring now to FIG. 1, there is illustrated a weapon system 10 approaching its target 12. Weapon system 10 is comprised of weapon 14 and pod 16. In the illustrative view of FIG. 1, pod 16 has been released from weapon 14. Weapon 14 may be any one of several types of weapons known in the prior art. As an example, weapon 14 may be a cruise missile fired from a remote launch platform 18. As another example, weapon 14 may be a "smart weapon" launched from a jet aircraft (not shown). It is understood that weapon system 10 may incorporate a wide variety of weapon 14 types that may be launched through the air towards a target 12. When launched, as from platform 18, pod 16 is integrated into weapon 14 such that system 10 is a single unit as it travels towards target 12. Just prior to impact with target 12, weapon 14 releases pod 16. When released, pod 16 begins to descend separately from weapon 14, as indicated by trajectory line 20.

Figure 2:
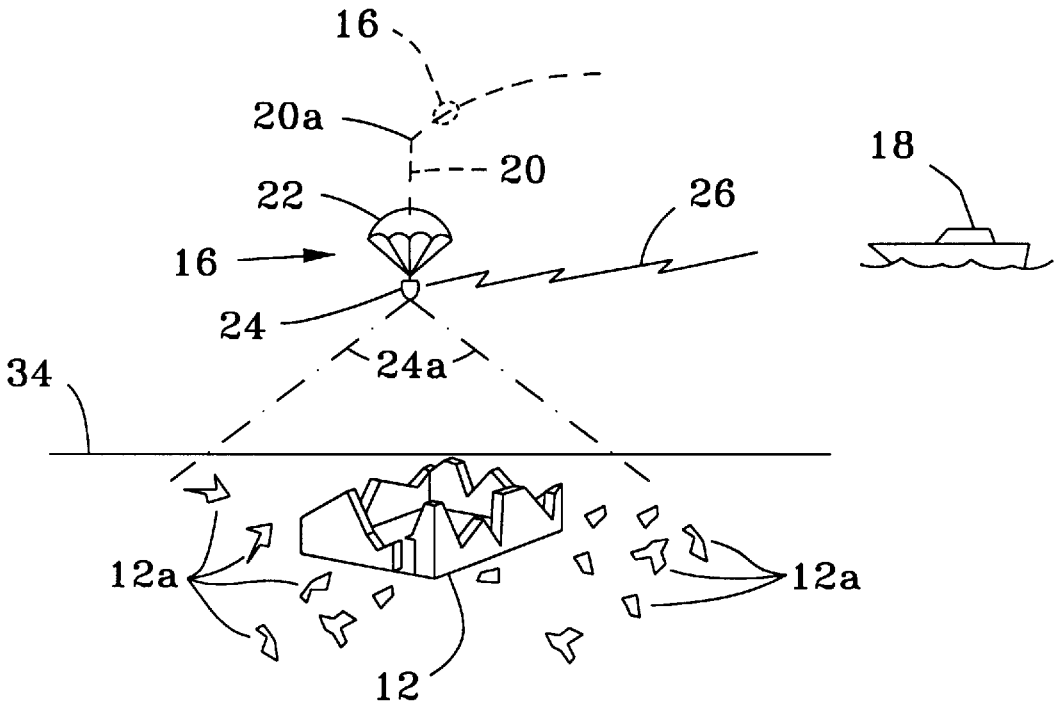
FIG. 2 is an illustrative view of the surveillance pod obtaining battle damage assessment data after impact of the weapon.

Referring now also to FIG. 2, pod 16 is shown in phantom in the same relative position as in FIG. 1. Shortly after being released from weapon 14, pod 16 deploys parachute 22 to slow its descent, as illustrated by the change in direction 20*a* in trajectory line 20. The timing of the release of pod 16 and the release mechanism itself will depend on the specific weapon 14 type being used. For self-guided missiles, such as the cruise missile, the release of pod 16 can be programmed into the flight instructions for weapon 14 so as to occur just prior to impact. In a preferred embodiment, release of pod 16 from weapon 14 will occur approximately three to four seconds before impact.

In the illustrative view of FIG. 2, weapon 14 (not shown) has impacted target 12, causing damage to target 12, illustrated by rubble 12*a*. Pod 16 includes camera 24, which gathers data on the damage to target 12, illustrated by lines 24*a*. The parachute 22 and camera 24 of pod 16 are configured such that the deployment of parachute 22 results in camera 24 being orientated in the general direction of target 12. As illustrated in FIG. 2, camera 24 is simply hung from parachute 22 so as to point in a downward direction. In a preferred embodiment, the camera incorporates a fish eye lens to obtain a wide angel view of the impact site. Parachute 22 slows the descent of pod 16 such that pod 16 remains in the air above target 12 for a time sufficient to obtain impact data to make reasonable damage assessments. Pod 16 will also include a communications link (line 26 in FIG. 2), such as a radio frequency link, so as to transmit the data to a control platform where the damage assessment can be performed. In the illustrative view of FIG. 2, communication link 26 is shown established to platform 18, but it is understood that link 26 may be established with any convenient platform, including a satellite relay.

Figure 3:
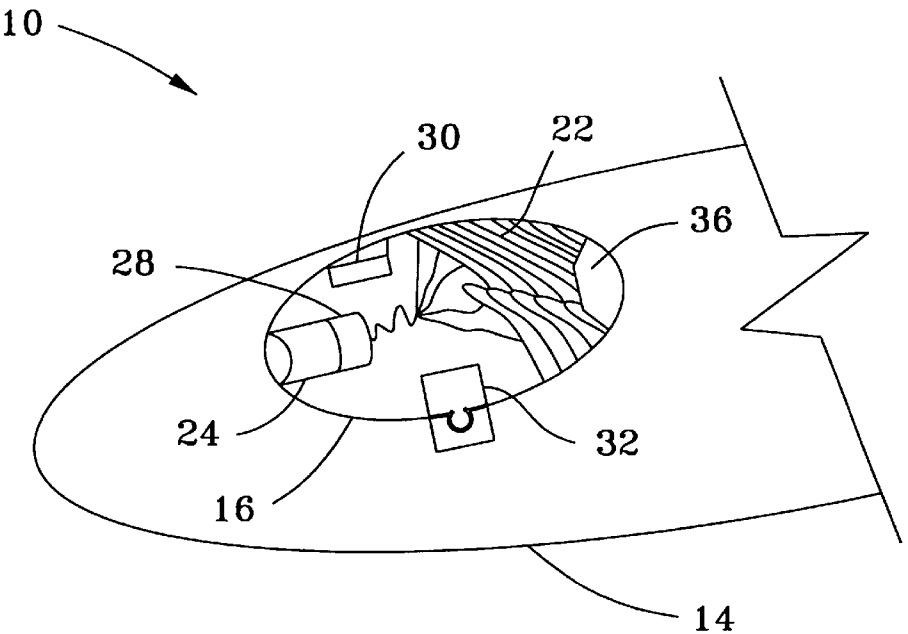
FIG. 3 is a diagrammatic representation of the weapon and surveillance pod of the present invention showing the major components of the system.

Referring now to FIG. 3, a schematic representation of system 10 is shown with pod 16 integrated within weapon 14. As noted previously, weapon 14 may be any type of weapon known in the prior art, such as a self-guided cruise missile, a laser-guided "smart weapon", or a conventional gravity bomb dropped from an aircraft platform. Weapon 14 need only be modified to accept and release pod 16. In addition to parachute 22 and camera 24, pod 16 includes communications equipment 28 for establishing link 26. In a preferred embodiment, camera 24 and equipment 28 will utilize well-known devices currently in use on "smart weapons" and self-guided missiles, configured to operate in the manner consistent with the operation of pod 16 described herein.

In the embodiment of FIG. 3, sensor 30 and release mechanism 32 are shown within pod 16. It will be understood that either, or both, sensor 30 and mechanism 32 may be incorporated into weapon 14. Sensor 30 determines the proper timing for release of pod 16 from weapon 14. The timing will vary with each weapon 14 type, depending on velocity, trajectory and other flight variables. As noted previously, the sensor 30 for a self-guided missile may consist of a programming sequence to recognize proximity to the target. For other weapon 14 types, sensor 30 may include altimeters, ground proximity sensors, a remote link to a control platform, or other well-known sensor devices that allow controlled release of pod 16 from weapon 14 just prior to impact. Release mechanism 32 may also be any well-known device capable of holding pod 16 integral with weapon 14 until activated by sensor 30 to release pod 16. As an example, release mechanism 32 may be a spring-loaded solenoid. Depending on the speed and trajectory of weapon 14, release mechanism 32 may eject pod 16 from weapon 14 with sufficient force to ensure pod 16 is clear from weapon 14 when parachute 22 is deployed. Trajectory 20 of FIG. 1 is intended to show the ejection of pod 16 clear of weapon 14.

Figure 4:
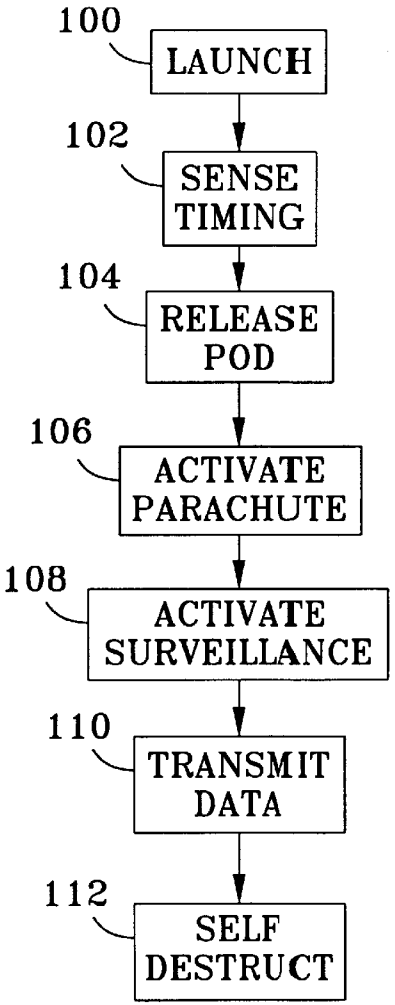
FIG. 4 is a block diagram of the method for implementing the weapon system of the present invention.

Turning now to FIG. 4, there is shown a block diagram of the method for implementing the weapons system of the present invention. Weapon system 10 is first launched (100) from platform 18. As weapons system 10 travels to target 12, sensor 30 determines the proper release timing (102). Pod 16 is released (104) from weapon 14 and parachute 22 is activated (106). Once camera 24 is in position, surveillance is activated (108) and data transmitted (110) via link 26. Pod 16 continues descending towards the earth 34 as it transmits data to platform 18. Pod 16 may also be fitted with an explosive device 36 so as to self-destruct (112) before reaching, or upon landing on, earth 34. In this manner, hostile forces may not obtain intelligence data from the communication link 26 and equipment 28.

The invention thus described provides improved damage assessment capabilities for a wide range of weapons. A releasable pod is easily attached or integrated into an existing weapon system. The weapon and the attached pod are launched towards a target. The pod is released from the weapon seconds before impact and falls clear of the weapon. A parachute is deployed from the pod to slow its descent such that the pod remains in the air after impact of the weapon with the target. A camera within the pod begins transmitting data taken from the impact site back to a control platform remote from the impact site. Damage assessments can be performed at the control platform to retarget future weapons launches as dictated by the assessment.

Although the present invention has been described relative to a specific embodiment thereof, it is not so limited. For example, camera 22 may include both visible and infrared light surveillance devices. Further, communications link 26 may be a two-way link such that platform 18 can communicate with pod 16 and link 26 may be active prior to separation of pod 16 from weapon 14. In this manner, platform 18 could control the release of pod 16. Additionally, a two-way communications link 26 would allow for controlling camera 22 from platform 18 to better aim and focus camera 22.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A weapon system for obtaining immediate battle damage assessment data comprising:

a weapon launched towards a target;

a releasable pod attached to the weapon, the pod being released from the weapon prior to impact of the weapon with the target, the pod obtaining the battle damage assessment data after the weapon has impacted the target, the pod transmitting the battle damage assessment data to a control platform;

a parachute joined to said pod and deployable after the pod is released from the weapon, the parachute slowing a descent rate of the pod relative to a descent rate of the weapon to enable the pod to obtain the battle damage assessment data from a position above the target after impact of the weapon;

surveillance equipment to obtain the battle damage assessment data; and communications equipment to transmit the battle damage assessment data.

2. The weapon system of claim 1, wherein the pod further comprises:

a sensor to determine timing of the release of the pod from the weapon; and a release mechanism activated by the sensor to release the pod from the weapon at the determined timing.

3. The weapon system of claim 1, wherein the surveillance equipment further comprises a camera having a fish eye lens.

4. The weapon system of claim 3, wherein the camera is a visible light camera.

5. The weapon system of claim 3, wherein the camera is an infrared camera.

6. The weapon system of claim 1, wherein the communications equipment further allows data transmission from the control platform to the pod.

7. The weapon system of claim 1, wherein the pod further comprises an explosive device.

8. The weapon system of claim 6, wherein said communications equipment comprises:

an antenna;

a transmitter joined to said surveillance equipment and said antenna for transmitting collected data; and a receiver joined to said surveillance equipment and said antenna for receiving control signals from the control platform and providing said control signals to said surveillance equipment.

9. The weapon system of claim 2, wherein:

said communications equipment allows data transmission from the control platform to the pod; and said communications equipment is joined to said release mechanism, said communications equipment signalling said release mechanism to release said pod.

10. The weapon system of claim 9, wherein said communications equipment is joined to said surveillance equipment and data transmission from the control platform to the pod controls said surveillance equipment.

* * * * *